United States Patent [19]

Cortez

[11] 4,173,085

[45] Nov. 6, 1979

[54] ANIMATED PAINTING

[76] Inventor: Pedro J. Cortez, 207 6th St., Calexico, Calif. 92231

[21] Appl. No.: 833,675

[22] Filed: Sep. 15, 1977

[51] Int. Cl.[2] ..... G09F 11/23

[52] U.S. Cl. ..... 40/433; 40/474

[58] Field of Search ..... 40/433, 900, 435, 442, 40/579, 219, 474; 362/806, 811

[56] References Cited

U.S. PATENT DOCUMENTS

| | | | |
|---|---|---|---|
| 791,303 | 5/1905 | Stuart et al. | 40/433 |
| 1,157,672 | 10/1915 | Brittain | 40/433 |
| 1,382,226 | 6/1921 | Pyper | 40/433 |
| 1,382,227 | 6/1921 | Pyper | 40/433 |
| 1,569,080 | 1/1926 | Fagerland | 40/433 |
| 2,056,383 | 10/1936 | Benway | 40/900 X |
| 3,313,041 | 4/1967 | Weigang | 40/433 |

*Primary Examiner*—John F. Pitrelli

[57] ABSTRACT

An illuminated animated picture comprises a preferably transparent front panel with a picture painted on the front surface thereof, this panel defining the forward member of a housing having a plurality of rotating discs therein which are illuminated from behind, these discs having "programmed" opaque portions, and the remaining portions being transparent, which cooperate with a multiplicity of holes drilled at strategic locations in the front panel to indicate stars, the moon, shimmering waters or other lighted areas of the picture which are caused to twinkle or glimmer due to the action of the rotating discs, the interior of the housing preferably being silvered except for broad areas on the front panel which are to emit a glow through the painting on the forward portion.

1 Claim, 6 Drawing Figures

ANIMATED PAINTING

BACKGROUND OF THE INVENTION

The invention is in the field of paintings or pictures or other displays of scenes which are caused to give the illusion of movement or twinkling by means of mobile structure disposed behind the picture.

Prior art samples of devices which operate along these general principals are represented in U.S. Pat. No. 1,403,631 which utilizes a similar principal wherein a roll of perforated material passes before a light to periodically illuminate and shade openings provided in the painting to cause a twinkling or shimmering effect. A rotary motion color wheel is shown in U.S. Pat. No. 3,419,988 and U.S. Pat. Nos. 1,843,897 2,213,261 disclose scenes which are animated in various ways by different shade producing moving reflectors.

The purpose of all these cited inventions is to produce a scene displaying some degree of animation or movement, although the variety of motions and colors may be somewhat limited.

SUMMARY OF THE INVENTION

It is the purpose of the present invention to provide a scene having actual illuminated lights that differ from one another both in size and color but also in the frequency of the blinking or shimmering of the lights and the direction of the light wave travel across the picture. Although prior art devices as mentioned above have attempted to achieve somewhat the same effect, they have been limited in that frequently it is obvious to a viewer that the scene is a painting having a unitary moving structure behind it.

The invention incorporates a housing with a silvered interior which reflects a great portion of the light produced by a string of bulbs through holes in the front panel, and a number of rotating transparent discs having programmed opaque portions painted thereon cause different holes drilled in the painting-supporting front panel to glimmer at different rates and with different phase relationships. The effect of this arrangement is a picture which appears quite life-like in that the glimmering or flashing of the different lights have a very independent appearance and it is not apparent that the motion is caused by a mechanical mechanism as with the prior art.

DETAILED DESCRIPTION OF THE PREFERRED EMBODIMENT

Figure 1:
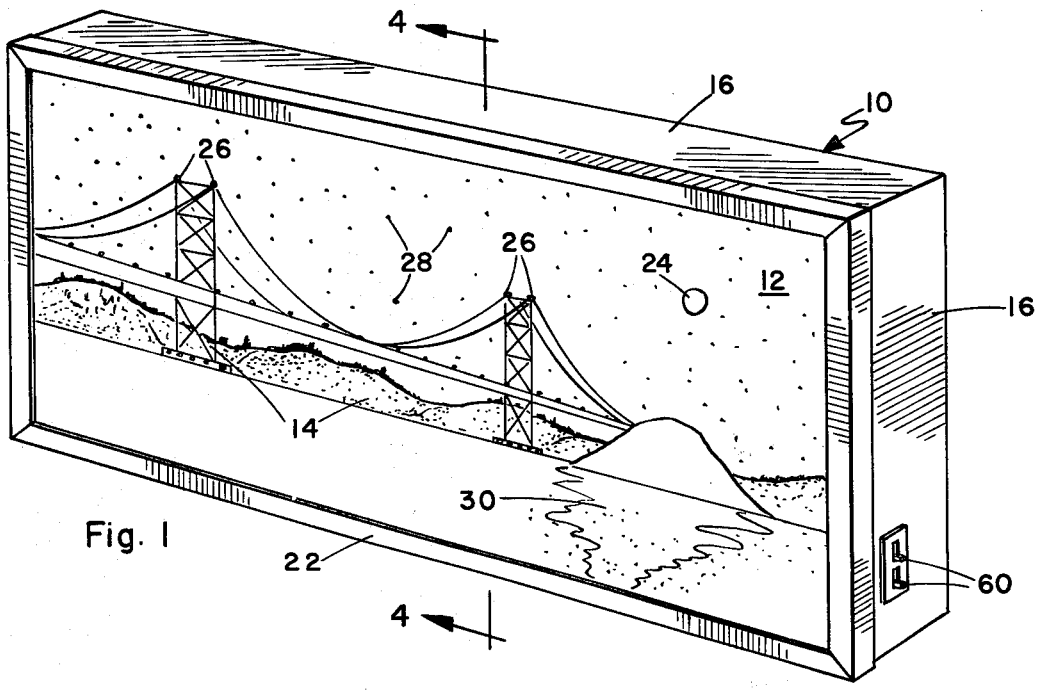
FIG. 1 is a perspective view of a complete framed picture.
Figure 2:
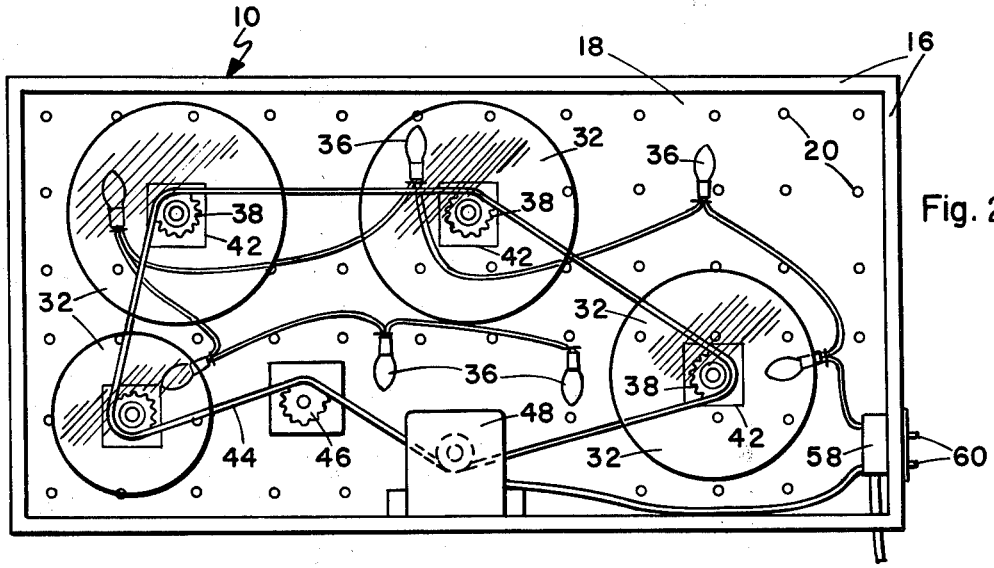
FIG. 2 is a front view of the frame structure and mechanism, with the picture removed.
Figure 3:
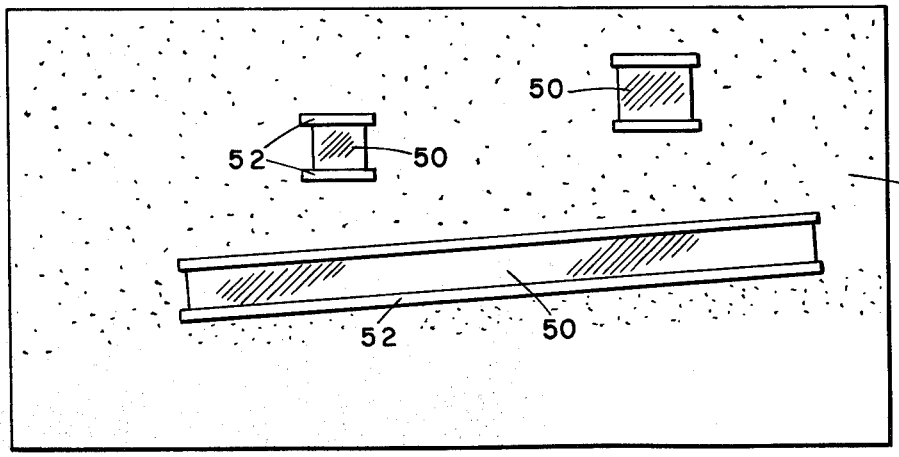
FIG. 3 is a rear view of the picture panel.

FIG. 1 provides an overall view of the apparatus as it appears in its finished state having a housing 10 with a front panel 12 the front surface of which displays a painting 14. The remainder of the housing is defined by slide panels 16 and a rear panel 18 which may have ventilation holes 20 therein for obvious reasons. The side and rear panels may be bevelled and fastened together in any means, and the front panel which has the painting is attached by means of molding 22 to the remainder of the housing.

Turning in more detail to the painting 14, a multiplicity of holes have been bored in the front panel 12 varying in size and corresponding to positions in the painting which would be lighted, such as the moon 24, avaition warning lights 26, stars 28 and a number of holes are drilled into the portion of the painting 30 which represents the reflection of the moonlight off the water which would ordinarily be glimmering.

There are also lights at the base of the bridge supports, along the bridge itself and other lights may be provided where they would naturally appear in real life such as in the buildings and streets of the hill behind the bridge.

The lights represented by these holes appear differently from one another in real life. For example, the moon obviously glows continuously whereas the stars 28 twinkle in a rather erratic manner. The aviation warning lights 26 flash with man-made regularity whereas the lights along the bridge surface and in the background buildings have a twinkle somewhat similar to that of the stars due to thermal discontininuities and the like in the atmosphere between the viewer and the lights. The reflection 30 of the moon of course twinkles in response to ripples and low waves in the bay waters.

Because all these lights in real life have different periods and produce different visual images, in order to make the painting appear not only animated but realistic, the light source provided to these openings must vary from one portion of the painting to the next and not be simply an obvious wave of light regularly passing behind the entire painting.

Figure 4:
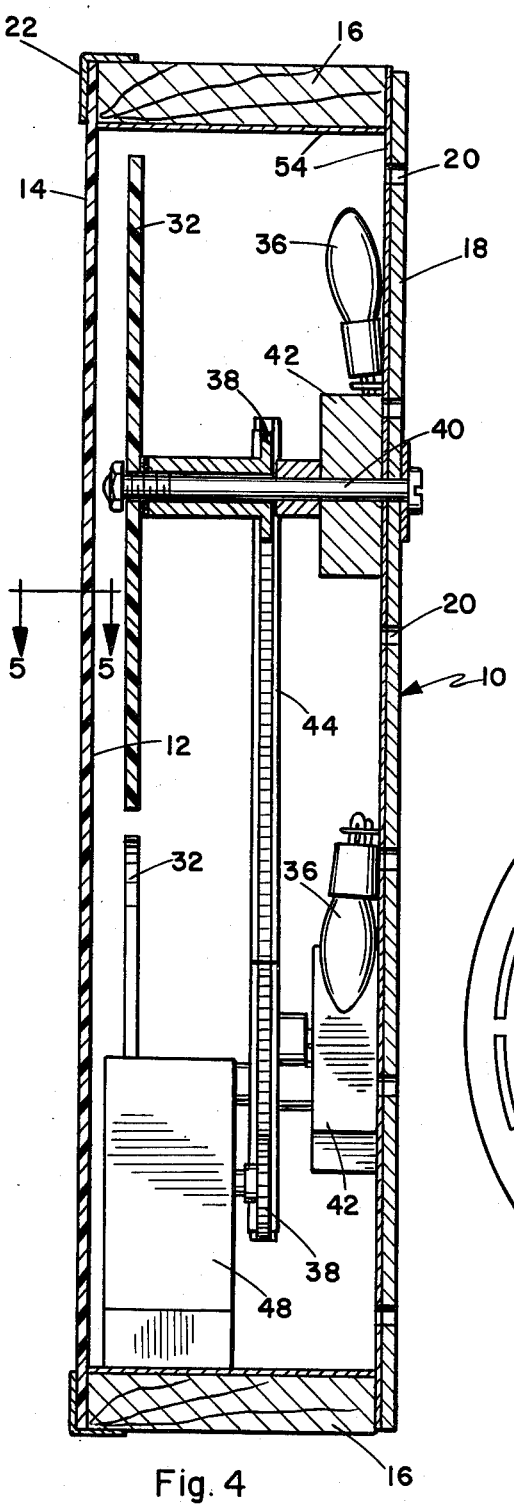
FIG. 4 is an enlarged sectional view taken on line 4—4 of FIG. 1.
Figure 5:
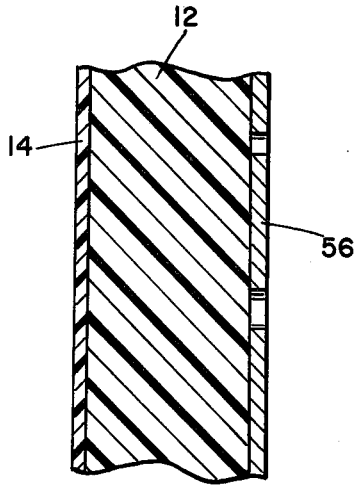
FIG. 5 is a further enlarged sectional view taken on line 5—5 of FIG. 4.
Figure 6:
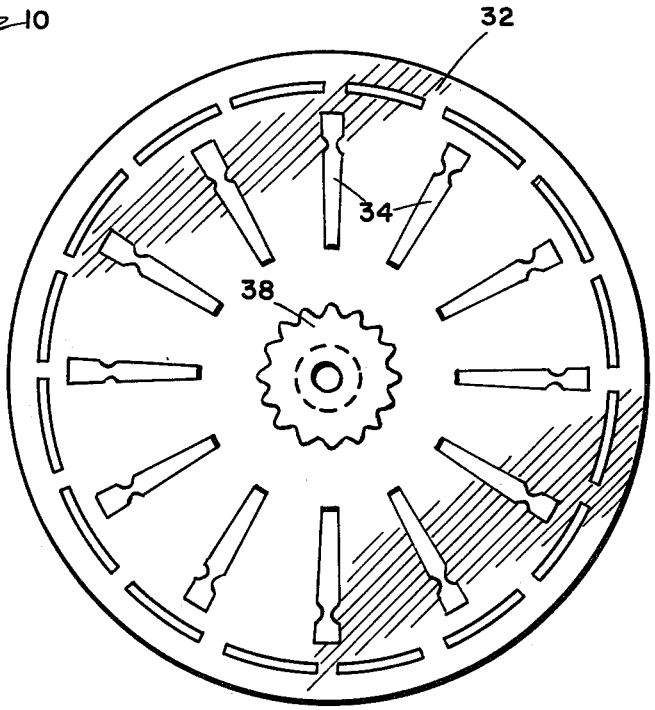
FIG. 6 illustrates the programming markings on a typical light control disc.

To achieve this result several transparent rotating disc members 32 are journalled behind the front panel 12 as is best seen in FIG. 4, and these discs are "programmed" with opaque painted portions 34 which shield the respective holes from the light of bulbs 36 as the discs rotate. Although clearly the means of mounting the discs is subject to some variation, as is shown in FIG. 4 the discs are rigidly connected to sprockets 38 and are journalled on bolt-axles 40 supported in anchoring blocks 42.

The discs are simultaneously driven by a chain or slotted belt member 44 which passes over an idler sprocket 46 and is driven by a motor 48. Although the same motor drives all of the discs, the blinking frequency of the lights is not the same because clearly the opaque masking elements 34 can be programmed in any desired arcuate width and pattern. Also because different portions of the different wheels move in opposite direction from other portions, it is not apparent from the front of the painting what the mechanism is that produces the animation. This is one of the results which the invention was designed to achieve.

Thus it can be seen that different flashing, glimmering and twinkling effects can be provided for the different lights enumerated above, and in addition by masking the appropriate holes with tinted cellophane 50 or other transparent material taped to the rear surface of the front panel 12 as at 52, different colors and shades of colors can be provided as well as different blinking frequency and period. The result is a truly fascinating and beautiful work of art that surpasses anything produced in the past.

The interior of the housing 10 is preferably substantially, completely silvered by means of foil as indicated at 54 on the rear and side panels. Since the front panel 12 is ideally transparent (except for the painting on the front), some light would be emitted through the paint if it were not for the fact that the rear of this panel is also silvered by means of foil or otherwise as shown at 56 except at those portions of the painting such as the reflection of the moon in the water where it is desired that the entire portion of the painting glow as well as glimmer through the holes that are provided. Because the entire interior of the housing 10 is substantially completely silvered, the light may reflect several times before passing out through the holes. Thus when walking by the painting, the different light bulbs 36 coupled with the multiple reflection will produce some natural glimmering at the holes in the front panel whether or not the discs are rotating. This of course enhances even further the magical quality of the invention.

A switch 58 is mounted in one of the side panels 16 and has double toggles 60 which control respectively the lights and the motor 48. It may be desirable in some instances to simply leave the lights on without providing the motion of the discs.

As thus shown and described, and subseqeuently claimed, the invention achieves a new dimension in the animation of otherwise lifeless pictures, both with the color, variety of frequency, and different surge direction of the lights produced by the painting, so that from a combination of known effects and elements a novel product is created which greatly outdistances the sum of its parts from an aesthetic point of view as well as from the aspects of realism.

I claim:

1. A light-animated picture comprising:

(a) an enclosing housing;

(b) said housing having a front panel having a pictoral display thereon which defines a plurality of different general areas of a single scene;

(c) said front panel having a multiplicity of transparent portions coincident with the locations of pictoral lights in said pictoral display and being partially transparent in other portions to produce a glow when backlighted;

(d) said housing interior being substantially completely silvered;

(e) a plurality of rotating members spaced along the rear surface of said front panel generally coincient with said general area journalled and on axes orthogonally related to said front panel, said rotating members each having coaxial drive sprockets and at least one opaque masking element to periodically cover said transparent portions;

(f) a motor mounted in said housing and a linear drive means engaged by said motor and encircling in driving relation all of said sprockets; and (g) several light bulbs positioned on the side of said rotating members remote from said front panel and at least some of said light bulbs being directly behind respective ones of said rotating members to selectively and intermittently illuminate the general areas of said display in front thereof to provide a twinkling effect and others of said light bulbs providing constant illumination of portions of said front panel in spaced areas between said rotating members whereby different areas of said display may be illuminated at different intensities by varying the strength of the individual light bulbs.

* * * * *